US008469457B1

(12) United States Patent
Schabacker

(10) Patent No.: US 8,469,457 B1
(45) Date of Patent: Jun. 25, 2013

(54) PAVEMENT CUTTING APPARATUS AND METHOD

(76) Inventor: Nolan D. Schabacker, Mesa, AZ (US)

( * ) Notice: Subject to any disclaimer, the term of this patent is extended or adjusted under 35 U.S.C. 154(b) by 1760 days.

(21) Appl. No.: 11/515,555

(22) Filed: Sep. 5, 2006

(51) Int. Cl.
*E01C 23/09* (2006.01)

(52) U.S. Cl.
USPC ..... 299/39.3

(58) Field of Classification Search
USPC ..... 299/39.3
See application file for complete search history.

(56) References Cited

U.S. PATENT DOCUMENTS 3,007,688 A * 11/1961 Hatcher ..... 299/39.3
3,291,532 A * 12/1966 Hatcher ..... 299/39.3
4,778,304 A 10/1988 Baldi
5,429,420 A 7/1995 Johnson
6,394,080 B1 5/2002 Zavala
6,467,201 B1 10/2002 McSharry et al.
2004/0007226 A1 1/2004 Denys

* cited by examiner

*Primary Examiner* — John Kreck

(57) ABSTRACT

A pavement cutting method and apparatus for cutting a concrete or asphalt pavement utilizes one or more cutter-mounting frames having one or more cutter assemblies mounted thereon for making a cut in a pavement. The leading end of each frame has a coupling for pivotally mounting the leading end of the frame to a towing vehicle for towing the frame so that the frame pivots about a vertical or substantially vertical pivot-axis passing through the coupling. Each of the one or more cutter assemblies has a driven rotary saw blade that is located in a common vertical or substantially vertical plane that contains the vertical or substantially vertical pivot-axis of the coupling whereby the saw blade of each of the one or more cutter assemblies follows the pivot-axis of the coupling when the frame is being towed in the cutting direction of travel for the pavement cutting apparatus.

23 Claims, 4 Drawing Sheets

50
28
52
4
4
26
56
40
46
46
40
5
5
22
54

PAVEMENT CUTTING APPARATUS AND METHOD

BACKGROUND OF THE INVENTION

The subject invention relates a pavement cutting apparatus and method for cutting or cutting and forming grooves or joints in concrete and asphalt pavement and, in particular, to an improved pavement cutting apparatus and method which eliminates any material oblique inclination of the rotary saw blade(s) of the pavement cutting apparatus to the direction of the cut being formed (any "crabbing" of the rotary saw blade (s) of the pavement cutting apparatus) by the pavement cutting apparatus. The pavement cutting apparatus and method of the subject invention can be used for tasks such as but not limited to: forming a joint or joints in pavement, cutting a pavement so that sections of the pavement can be removed from the pavement, etc. As used herein, the term pavement includes pavement structures such as but not limited to roads, sidewalks, airport runways, industrial and commercial floors, parking lots, ramps, aprons, etc.

Current pavement cutting equipment and methods typically utilize pavement cutting apparatus wherein the rotary cutting blade of the pavement cutting equipment is: pushed through the pavement by the pavement cutting equipment to form a cut in the pavement; offset to one side of the pavement cutting equipment; and rotated about an axis that remains perpendicular to the front-to-rear centerline of the pavement cutting equipment. With this structure, the cutting of a pavement with the offset rotary saw blade of the pavement cutting equipment produces a drag on the side of the pavement cutting equipment where the offset rotary saw blade is located. If there is no compensation for this drag, the drag will cause the pavement cutting equipment to move laterally to the direction of the intended cut-line. To compensate for this rotary saw blade induced drag on one side of the pavement cutting equipment, the operator of the pavement cutting equipment must orient the pavement cutting equipment at an angle to the direction of the cut being made in the pavement with the rotary saw blade so that the pavement cutting equipment continues to move in the direction of and along an intended cut-line. Since the rotary saw blade of the pavement cutting equipment rotates about an axis that remains perpendicular to the front-to-rear centerline of the pavement cutting equipment, this orientation of the pavement cutting equipment at an angle to the direction of the intended cut-line also orients the rotary saw blade at an angle to the cut being formed in the pavement with the rotary saw blade. The oblique inclination of the rotary saw blade of the pavement cutting equipment to the cut being formed in the pavement by the rotary saw blade: places stresses on the rotary saw blade that shortens the service life of the rotary saw blade; can cause the center of the rotary saw blade to break out; and causes spalling (chipping) of the cut edges at the pavement surface which adversely affects the appearance of the cut.

Some pavement cutting equipment and methods utilize pavement cutting apparatus wherein the rotary cutting blade of the pavement cutting equipment is pushed through the pavement by the pavement cutting equipment to form a cut in the pavement and rotated about an axis that remains perpendicular to the front-to-rear centerline of the pavement cutting equipment, but wherein the rotary saw blade is located on the front-to-rear centerline of the pavement cutting equipment. However, even with this structure, when the pavement cutting equipment is forming a cut in a pavement that is inclined laterally to the intended cut-line, if there is no compensation for the lateral inclination, the pavement cutting equipment will move both in the direction of the intended cut-line and downward laterally to the direction of the intended cut-line in the direction of the pavement incline. To compensate for this potential lateral movement of the pavement cutting equipment and keep the rotary saw blade on the intended cut-line, the operator of the pavement cutting equipment must orient the pavement cutting equipment at an angle to the direction of the cut being made in the pavement with the rotary saw blade so that the pavement cutting equipment continues to move in the direction of and along an intended cut-line. Since the rotary saw blade of the pavement cutting equipment rotates about an axis that remains perpendicular to the front-to-rear centerline of the pavement cutting equipment, this orientation of the pavement cutting equipment at an angle to the direction of the intended cut-line also orients the rotary saw blade at an angle to the cut being formed in the pavement with the rotary saw blade. The oblique inclination of the rotary saw blade of the pavement cutting equipment to the cut being formed in the pavement by the rotary saw blade: places stresses on the rotary saw blade that shortens the service life of the rotary saw blade; can cause the center of the rotary saw blade to break out; and causes spalling (chipping) of the cut edges at the pavement surface which adversely affects the appearance of the cut.

SUMMARY OF THE INVENTION

The pavement cutting apparatus and method of the subject invention provide a solution to the above-discussed problems associated with the pavement cutting equipment of the prior art. The pavement cutting apparatus and method of the subject invention for cutting a concrete or asphalt pavement utilize a leading end mounted cutter-mounting frame having one or more cutter assemblies mounted thereon for making a cut (e.g. a joint or other cut) in a pavement. The cutter-mounting frame with the cutter assemblies is towed or pulled, not pushed, when in operation. The leading end of the pavement cutting apparatus has a coupling for pivotally connecting the leading end of the cutter-mounting frame to a towing vehicle for towing the cutter-mounting frame so that the cutter-mounting frame pivots about a vertical or substantially vertical pivot-axis passing through the coupling. Each of the one or more cutter assemblies mounted on the cutter-mounting frame has a driven rotary saw blade which comprises a disc with peripheral cutting teeth on its outer circumference. The disc of the rotary saw blade of each of the one or more cutter assemblies is located in a common vertical or substantially vertical plane that contains the vertical or substantially vertical pivot-axis of the coupling (the disc of each of the rotary saw blades is in the same plane as the vertical or substantially vertical pivot-axis of the coupling).

With the structure of the pavement cutting apparatus of the subject invention, a cut is formed in a pavement along a desired line by aligning the pivot-axis of the coupling of the pavement cutting apparatus with the intended cut-line and maintaining the pivot-axis of the coupling aligned with and moving along the intended cut-line while a cut is being made in the pavement with the pavement cutting apparatus. With this structure, when the cutter-mounting frame is being towed in the cutting direction of travel for the pavement cutting apparatus to form a generally vertically extending cut in a pavement: the saw blade of each of the one or more cutter assemblies follows the vertical or substantially vertical pivot-axis of the coupling; the rotary saw blade of each of the one or more cutter assemblies is aligned with and contained in a common plane with the vertical or substantially vertical pivot-axis of the coupling; where there are a plurality of the cutter assemblies mounted on the cutter-mounting frame, the rotary saw blade of each of the cutter assemblies is aligned with and in the same plane as the rotary saw blade of each of the one or more other cutter assemblies; and any oblique inclination of the rotary saw blade(s) of the pavement cutting apparatus to the direction of the cut being formed by the pavement cutting apparatus is eliminated or substantially eliminated even when the pavement is inclined laterally to the intended cut-line and the vehicle has to be oriented at an angle to the direction of the cut being made in the pavement with the rotary saw blade(s) so that the pavement cutting equipment continues to move in the direction of and along an intended cut-line. The elimination of any material oblique inclination of the rotary saw blade(s) of the pavement cutting equipment of the subject invention to the cut being formed in a pavement by the rotary saw blade(s): reduces the amount of stress on the rotary saw blade(s) that would otherwise shorten the service life of the rotary saw blade(s); can prevent a breakout of the center(s) of the rotary saw blade(s) during service; and can reduce or essentially eliminate spalling (chipping) of the cut edges at the pavement surface which would adversely affect the appearance of the cut.

Where two or more cutter assemblies are mounted on the cutter-mounting frame, the rotary saw blades of the cutter assemblies normally successively increase the depth of the cut being made in the pavement by the cutter assemblies, e.g. through the use of successive cutter assemblies with successively greater diameter rotary saw blades and/or through the use of successive cutter assemblies with rotary saw blades having axes of rotation that are successively lower. The cutting depth of the rotary saw blade of any one or more or all of the cutter assemblies can be adjustable independently of the rotary saw blades of the other of the cutter assemblies.

DESCRIPTION OF THE PREFERRED EMBODIMENTS

Figure 1:
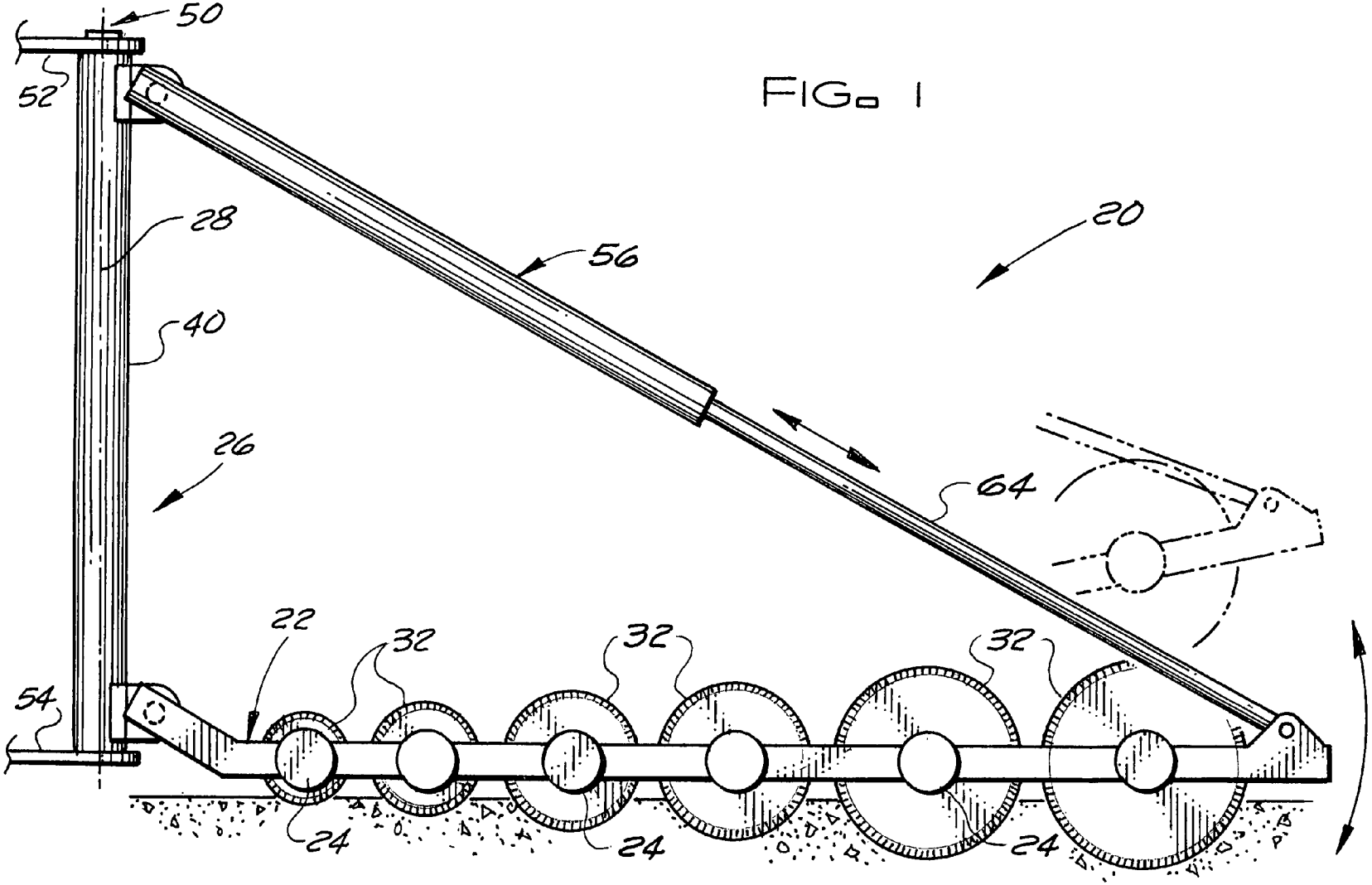
FIG. 1 is a schematic side view of a pavement cutting apparatus of the subject invention.
Figure 2:
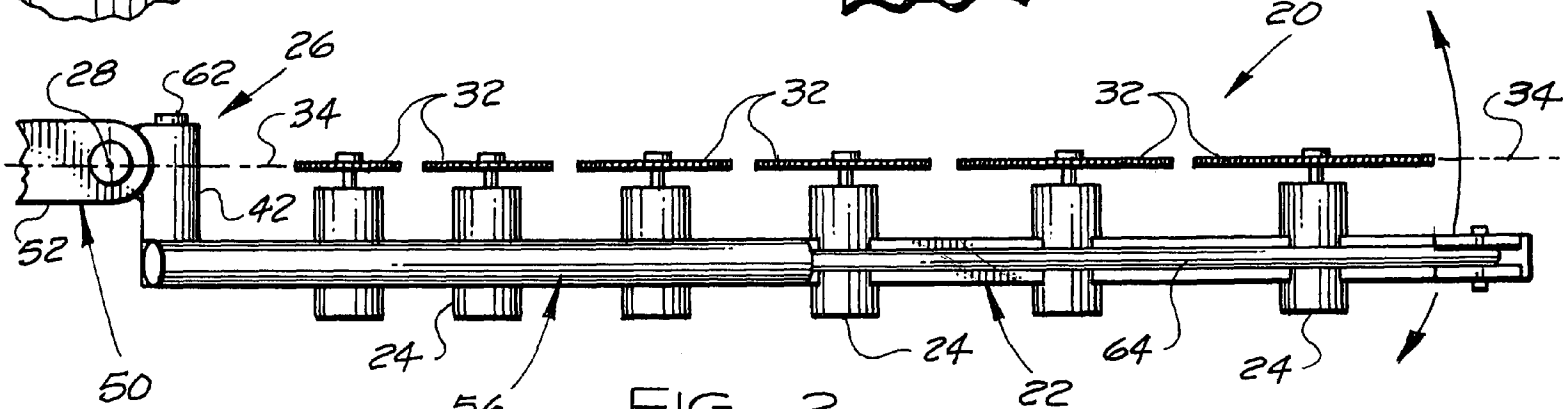
FIG. 2 is a schematic plan view of the pavement cutting apparatus of FIG. 1.

The pavement cutting equipment of the subject invention for cutting a concrete or asphalt pavement has one or more pavement cutting apparatuses 20. As shown in FIGS. 1 and 2, the pavement cutting apparatus 20 of the subject invention for cutting a concrete or asphalt pavement has a leading end mounted cutter-mounting frame 22 with one or more cutter assemblies 24 mounted thereon for making a cut, e.g. a joint or other cut, in a pavement. The cutter-mounting frame 22 has a leading end and a trailing end relative to a cutting direction of travel for the pavement cutting apparatus 20 when the pavement cutting apparatus 20 is cutting a pavement. The pavement cutting apparatus 20 has a coupling 26 for pivotally connecting the leading end of the cutter-mounting frame 22 to a towing vehicle for towing the pavement cutting apparatus 20 so that the cutter-mounting frame 22 pivots about a vertical or substantially vertical pivot-axis 28 of the coupling 26. Each of the one or more cutter assemblies 24 mounted on the cutter-mounting frame 22 has a driven rotary saw blade 32 which comprises a disc with peripheral cutting teeth on its outer circumference, e.g. a conventional diamond toothed rotary saw blade. The disc of the rotary saw blade 32 of each of the one or more cutter assemblies 24 is located in a common vertical or substantially vertical plane 34 that also contains the vertical or substantially vertical axis 28 of the coupling 26. The common vertical or substantially vertical plane 34 is schematically represented in FIG. 2 and extends perpendicular to the sheet of the drawing from line 34 of FIG. 2 which passes through the pivot-axis 28 of the coupling 26 and disc of each of the saw blades 32. With this structure, a cut is formed in a pavement along an intended cut-line by aligning the pivot-axis 28 of the coupling 26 of the pavement cutting apparatus 20 with the intended cut-line and maintaining the pivot-axis of the coupling aligned with the intended cut-line while a cut is being made with the pavement cutting apparatus 20. With this structure, when the pavement cutting apparatus 20 is being towed in the cutting direction of travel for the pavement cutting apparatus 20 to form a generally vertically extending cut in a pavement: the rotary saw blade 32 of each of the one or more cutter assemblies 24 follows the vertical or substantially vertical pivot-axis 28 of the coupling 26; the disc of the rotary saw blade 32 of each of the one or more cutter assemblies 24 is aligned with and contained in the common plane 34 with the vertical or substantially vertical pivot-axis 28 of the coupling 26; where there are a plurality of the cutter assemblies 24, the disc of the rotary saw blade 32 of each of the cutter assemblies 24 is aligned with and contained in the common plane 34 with the rotary saw blade 32 of each of the one or more other cutter assemblies 24; and any oblique inclination of the rotary saw blade(s) 32 of the pavement cutting apparatus to the direction of the cut being formed by the pavement cutting apparatus and associated problems are eliminated or substantially eliminated even when the pavement is inclined laterally to the intended cut-line and the towing vehicle has to be oriented at an angle to the direction of the cut being made in the pavement with the rotary saw blade(s) so that the pavement cutting equipment continues to move in the direction of and along an intended cut-line.

Figure 5:
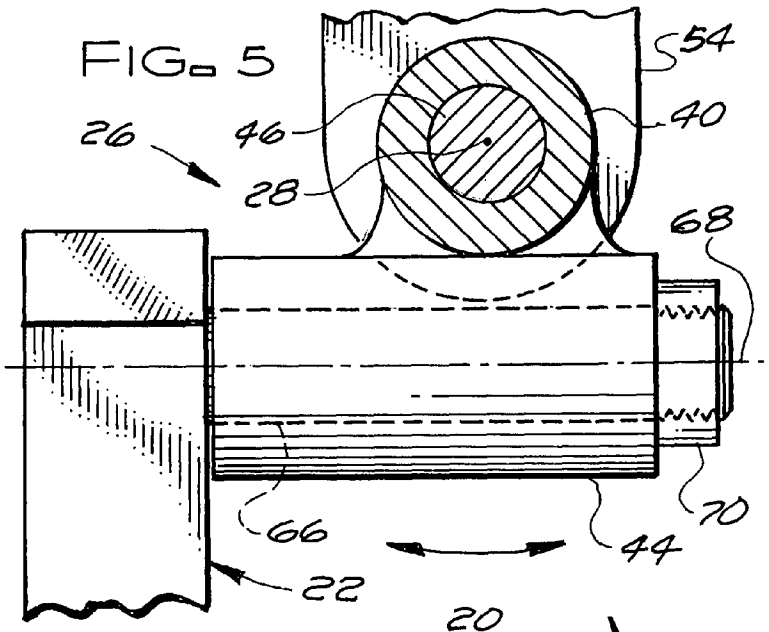
FIG. 5 is a schematic view of the coupling of the pavement cutting apparatus of FIG. 1 taken substantially along lines 5-5 of FIG. 3 and on a larger scale than FIG. 1.
Figure 4:
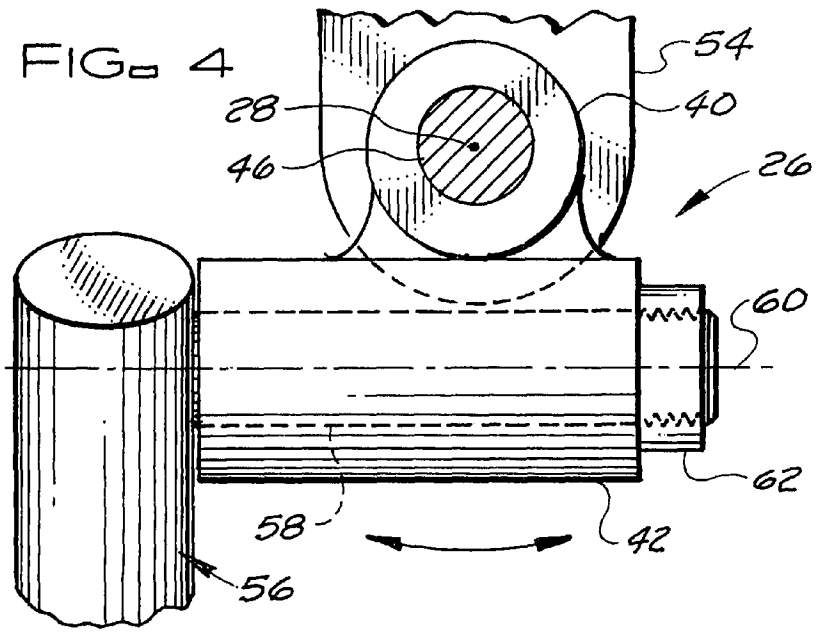
FIG. 4 is a schematic view of the coupling of the pavement cutting apparatus of FIG. 1 taken substantially along lines 4-4 of FIG. 3 and on a larger scale than FIG. 1.
Figure 3:
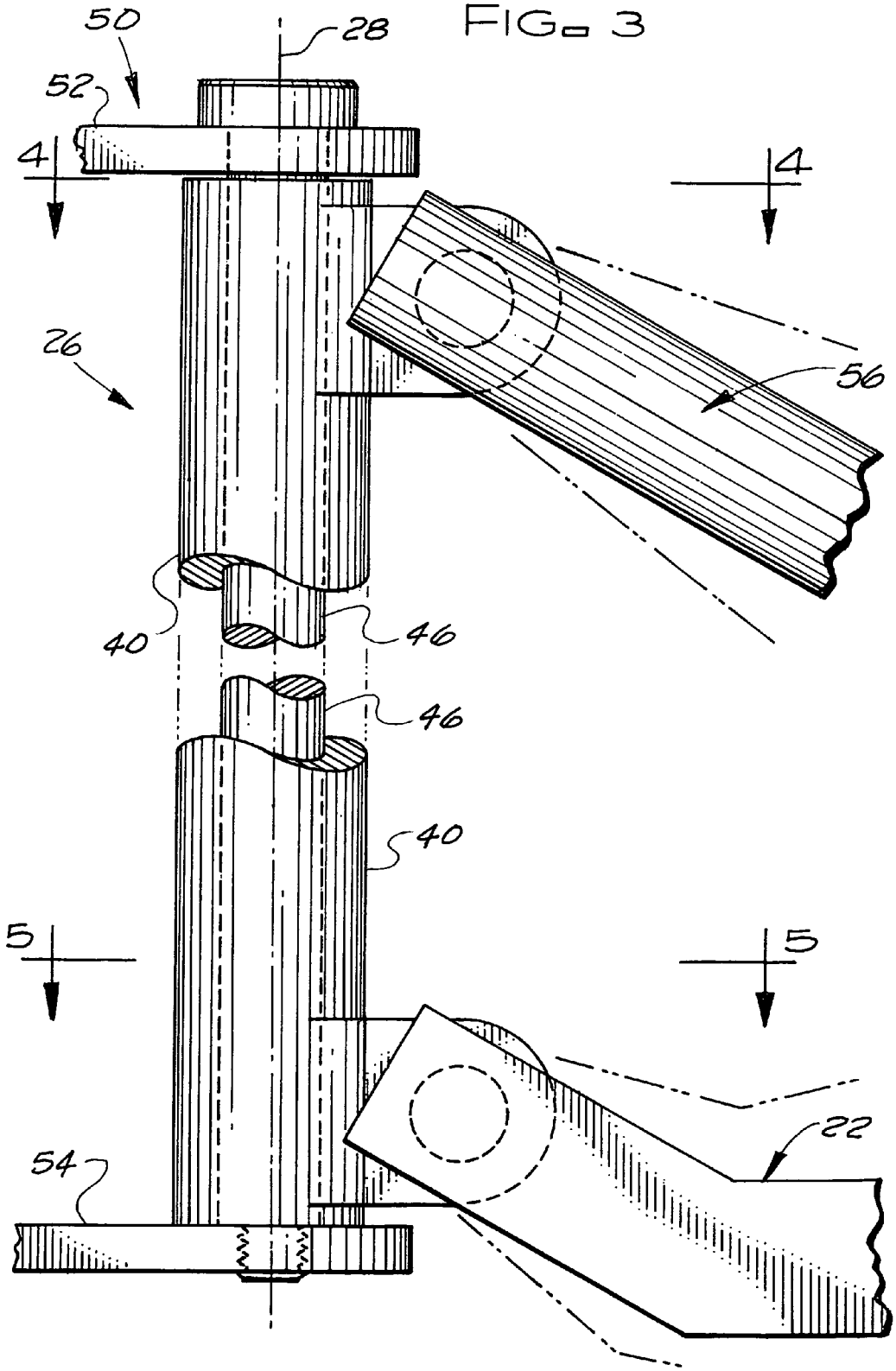
FIG. 3 is a fragmentary schematic side view, partially in section, of the coupling of the pavement cutting apparatus of FIG. 1 on a larger scale than FIG. 1.

The pavement cutting apparatus coupling 26 of FIGS. 1 and 2 is shown in greater detail in FIGS. 3 to 5 and includes a vertically extending or substantially vertically extending coupling sleeve 40 with upper and lower horizontally or substantially horizontally extending hinge sleeves 42 and 44 welded or otherwise affixed to the vertically extending or substantially vertically extending sleeve 40. The coupling sleeve 40 is pivotally mounted on a vertically extending or substantially vertically extending coupling pin 46 of a towing vehicle coupling. As shown, the towing vehicle coupling also includes a mounting bracket 50 affixed to the frame (not shown) of the towing vehicle. The coupling pin 46 extends down through a bore in an upper member 52 of the mounting bracket 50 of the towing vehicle coupling and is threaded into a threaded bore in a lower member 54 of mounting bracket 50 of the towing vehicle coupling so that the pavement cutting apparatus 20 can be detachably secured to the towing vehicle. With this structure, the coupling sleeve 40 of the pavement cutting apparatus coupling 26 is pivotally secured to a towing vehicle so that the coupling 26 pivots about the vertical or substantially vertical coupling pivot-axis 28 that is coincident with the longitudinal centerline of the towing vehicle coupling pin 46.

As shown in FIGS. 1 to 4, the pavement cutting apparatus 20 has a pneumatic or hydraulic control cylinder 56 for raising and lowering the trailing end of the cutter-mounting frame 22 of the pavement cutting apparatus 20. The control cylinder 56 is pivotally secured to the upper hinge sleeve 42 by a hinge pin 58. The hinge pin 58 is affixed to and extends horizontally or substantially horizontally from a leading end of the control cylinder 56 through the upper hinge sleeve 42. The hinge pin 58 is rotatably received within the upper hinge sleeve 42 so that the control cylinder 56 is pivotally mounted to the upper hinge sleeve 42 of the coupling 26 and pivots about a horizontal or substantially horizontal hinge axis 60 that is coincident with the longitudinal centerline of the hinge pin 58. The free end of the hinge pin 58 has a retaining nut 62 threaded onto the hinge pin so that the control cylinder 56 is detachably mounted to the coupling 26 of the pavement cutting apparatus 20. A piston driven rod 64 extends from the control cylinder 56 and is pivotally attached to the trailing end of the cutter-mounting frame 22 so that the trailing end of the cutter-mounting frame 22 can be raised and lowered, by retracting and extending the rod 64 of the control cylinder 56, to regulate the depth of a cut being made by the pavement cutting apparatus 20 and to raise the saw blade(s) 32 of the pavement cutting apparatus 20 out of contact with the ground or a pavement when the pavement cutting apparatus is not in use.

As shown in FIGS. 3 and 5, the leading end of the cutter-mounting frame 22 of the pavement cutting apparatus 20 is pivotally secured to the lower hinge sleeve 44 by a hinge pin 66. The hinge pin 66 is affixed to and extends horizontally or substantially horizontally from the leading end of the cutter-mounting frame 22 through the lower hinge sleeve 44. The hinge pin 66 is rotatably received within the lower hinge sleeve 44 so that the cutter-mounting frame 22 is pivotally mounted to the lower hinge sleeve 44 of the coupling 26 and pivots about a horizontal or substantially horizontal hinge axis 68 that is coincident with the longitudinal centerline of the hinge pin 66. The free end of the hinge pin 66 has a retaining nut 70 threaded onto the hinge pin so that the cutter-mounting frame 22 is detachably mounted to the coupling 26 of the pavement cutting apparatus. With the leading end of the cutter-mounting frame 22 pivotally attached to coupling 26 of the pavement cutting apparatus 20, the trailing end of the cutter-mounting frame 22 can be raised and lowered, by withdrawing or extending the rod 64 of the control cylinder 56, to regulate the depth of a cut being made by the pavement cutting apparatus 20 and to raise the saw blade(s) 32 of the pavement cutting apparatus 20 out of contact with the ground or a pavement when the pavement cutting apparatus is not in use.

With the structure of the pavement cutting apparatus coupling 26, the cutter-mounting frame 22 and the control cylinder 56 are offset by the upper and lower hinge sleeves 42 and 44 from the coupling sleeve 40 so that when the pavement cutting apparatus 20 is being towed in the cutting direction of travel for the pavement cutting apparatus 20 to form a generally vertically extending cut in a pavement: the rotary saw blade 32 of each of the one or more cutter assemblies 24 follows the vertical or substantially vertical pivot-axis 28 of the coupling 26; the disc of the rotary saw blade 32 of each of the one or more cutter assemblies 24 is aligned with and contained in the common plane 34 that also contains the vertical or substantially vertical pivot-axis 28 of the coupling 26; and, where there are a plurality of the cutter assemblies 24, the disc of the rotary saw blade 32 of each of the cutter assemblies 24 is aligned with and contained in the common plane 34 with the rotary saw blade 32 of each of the one or more other cutter assemblies 24. While one form of coupling for the pavement cutting apparatus 20 has been shown and described, it is contemplated that other couplings could be used to couple the pavement cutting apparatus 20 to a towing vehicle provided, when the pavement cutting apparatus 20 is being towed in the cutting direction of travel for the pavement cutting apparatus 20 to form a generally vertically extending cut in a pavement: the rotary saw blade 32 of each of the one or more cutter assemblies 24 follows the vertical or substantially vertical pivot-axis 28 of the coupling where the coupling is pivotally connected to the towing vehicle; the disc of the rotary saw blade 32 of each of the one or more cutter assemblies 24 is aligned with and contained in the common plane 34 that also contains the vertical or substantially vertical pivot-axis 28 of the coupling; and, where there are a plurality of the cutter assemblies 24, the disc of the rotary saw blade 32 of each of the cutter assemblies 24 is aligned with and contained in the common plane 34 with the rotary saw blade 32 of each of the one or more other cutter assemblies 24.

Where two or more cutter assemblies 24 are mounted on the cutter-mounting frame 22, normally, the rotary saw blades 32 of the cutter assemblies successively increase the depth of the cut being made in the pavement by the cutter assemblies e.g. through the use of successive cutter assemblies 24 with successively greater diameter rotary saw blades 32 and/or through the use of successive cutter assemblies 24 with rotary saw blades 32 having axes of rotation that are successively lower. The cutting depth of the rotary saw blade 32 of any one or more or all of the cutter assemblies 24 can be adjustable independently of the rotary saw blades 32 of the other of the cutter assemblies 24. The rotary saw blades 32 of the cutter assemblies 24 can be driven in either a clockwise or counter-clockwise direction. The rotary saw blades 32 of the cutter assemblies 24 may be driven by various drive assemblies, such as but not limited to belt, chain, and/or gear trains that are powered by a common conventional electrical, hydraulic, gas, diesel, or air powered motor or engine; individual electrical, hydraulic, gas, diesel, or air powered motors or engines; etc. The towing vehicle will normally be the power source and the coolant source for the rotary saw blades 32.

Figure 6:
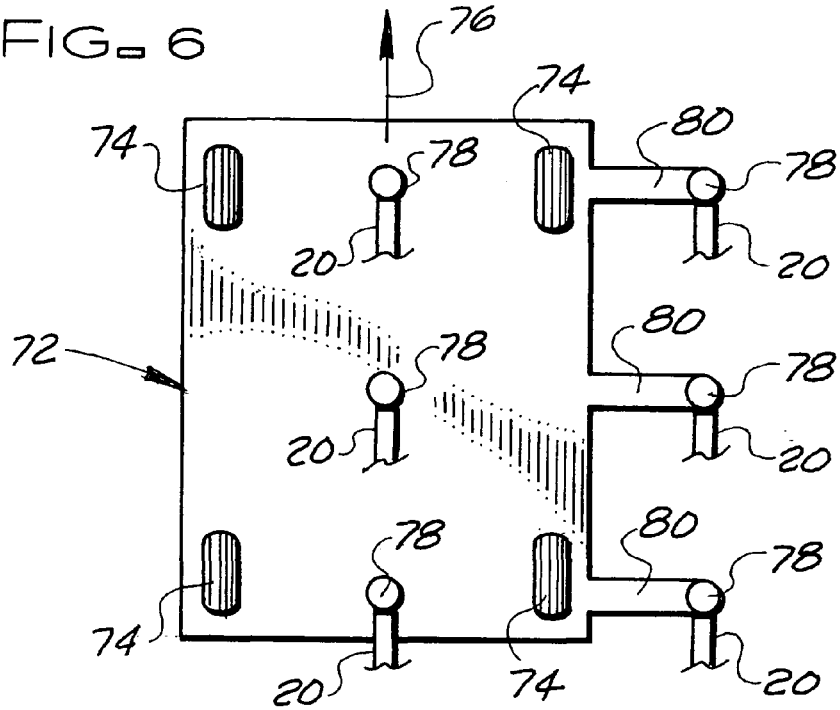
FIG. 6 is a schematic plan view showing examples of different locations for mounting the pavement cutting apparatus of the subject invention on a towing vehicle.

FIG. 6 schematically shows examples of a number of coupling locations where the pavement cutting apparatus 20 could be pivotally connected to and towed by a motorized towing vehicle. The motorized towing vehicle is represented by the rectangle 72, the wheels of the towing vehicle are represented by 74, the cutting direction of travel for the pavement cutting apparatus 20 is represented by arrow 76, and the pavement cutting apparatuses are represented by fragmented rectangles 20. While the coupling locations 78 are only shown along a front-to-rear centerline of the towing vehicle and on outriggers 80 on the right side of the towing vehicle 72, the coupling locations 78 can be placed at other locations on or attached to the vehicle such as but not limited to outriggers on the left side of towing vehicle 72 (not shown). The towing vehicle 72 and the pavement cutting apparatus 20 can be an integral unit (e.g. where the vehicle's sole purpose is for towing the pavement cutting apparatus 20) or the towing vehicle 72 can be a vehicle that can also be used for other tasks (e.g. a conventional tractor) to which the pavement cutting apparatus 20 is connected (e.g. to perform a specific pavement cutting operation or operations).

Figure 7:
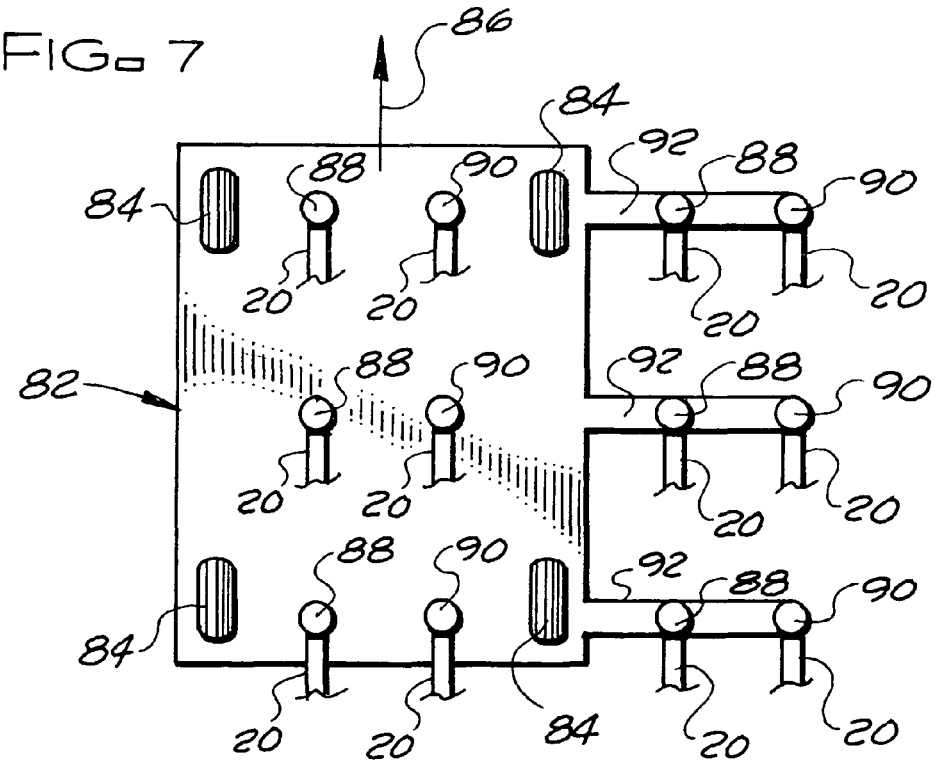
FIG. 7 is a schematic plan view showing examples of different locations for mounting more than one of the pavement cutting apparatuses of the subject invention on a towing vehicle.

FIG. 7 schematically shows examples of a number of coupling locations where two or more of the pavement cutting apparatuses 20 (only two are shown) could be pivotally connected to a motorized towing vehicle. The motorized towing vehicle is represented by the rectangle 82, the wheels of the towing vehicle are represented by 84, the cutting direction of travel for the pavement cutting apparatuses 20 is represented by arrow 86, and the pavement cutting apparatuses are represented by rectangles 20. While the pairs of coupling locations 88 and 90 shown are only shown straddling a front-to-rear centerline of the towing vehicle and on outriggers 92 on the right side of the towing vehicle 82, the coupling locations 88 and 90 can be placed at other locations on or attached to the vehicle such as but not limited to outriggers on the left side of towing vehicle 82 (not shown). With the pairs of pavement cutting apparatus coupled to the towing vehicle 82 at a locations spaced from each other in a direction perpendicular to the front-to-rear centerline of the pavement cutting apparatuses, in use, the cutter assemblies 24 of the two pavement cutting apparatuses shown form parallel spaced apart cuts when the pavement cutting apparatuses are being towed in the cutting direction of travel for the pavement cutting apparatuses. The towing vehicle 82 and the pavement cutting apparatuses 20 can be an integral unit (e.g. where the vehicle's sole purpose is for towing the pavement cutting apparatuses 20) or the towing vehicle 82 can be a vehicle that can also be used for other tasks (e.g. a conventional tractor) to which the pavement cutting apparatuses 20 are connected (e.g. to perform a specific pavement cutting operation or operations).

In describing the invention, certain embodiments have been used to illustrate the invention and the practices thereof. However, the invention is not limited to these specific embodiments as other embodiments and modifications within the spirit of the invention will readily occur to those skilled in the art on reading this specification. Thus, the invention is not intended to be limited to the specific embodiments disclosed, but is to be limited only by the claims appended hereto.

What is claimed is:

1. Pavement cutting equipment for cutting a concrete or asphalt pavement, comprising:

a first pavement cutting apparatus; the first pavement cutting apparatus comprising:

a first cutter-mounting frame having one or more cutter assemblies mounted thereon for making a cut in a pavement; the first cutter-mounting frame, relative to a cutting direction of travel for the first pavement cutting apparatus when the first pavement cutting apparatus is cutting a pavement, having a leading end and a trailing end;

a first coupling for pivotally connecting the leading end of the first cutter-mounting frame to a towing vehicle for towing the first pavement cutting apparatus so that the first cutter-mounting frame pivots about a vertical or substantially vertical pivot-axis passing through the first coupling; and each of the one or more cutter assemblies having a driven rotary saw blade; the rotary saw blade of each of the one or more cutter assemblies being a disc with peripheral cutting teeth; and the disc of the rotary saw blade of each of the one or more cutter assemblies being located in a common vertical or substantially vertical plane that also contains the vertical or substantially vertical pivot-axis of the first coupling whereby when the first pavement cutting apparatus is being towed in the cutting direction of travel for the first pavement cutting apparatus to form a generally vertically extending cut in a pavement, the rotary saw blade of each of the one or more cutter assemblies follows the vertical or substantially vertical pivot-axis of the first coupling, the rotary saw blade of each of the one or more cutter assemblies is aligned with and contained in a common plane with the vertical or substantially vertical pivot-axis of the first coupling, and, where there are a plurality of the cutter assemblies mounted on the first cutter-mounting frame, the rotary saw blade of each of the cutter assemblies is aligned with and in the same plane as the rotary saw blade of each of the one or more other cutter assemblies.

2. The pavement cutting equipment according to claim 1, wherein:

there is a plurality of the cutter assemblies mounted on the first cutter-mounting frame.

3. The pavement cutting equipment according to claim 2, wherein:

the cutter assemblies successively increase the depth of the cut being made by the cutter assemblies.

4. The pavement cutting equipment according to claim 2, wherein:

the cutting depth of each of the cutter assemblies is adjustable independently of the other of the cutter assemblies.

5. The pavement cutting equipment according to claim 1, wherein:

there are a series of at least three of the cutter assemblies mounted on the first cutter-mounting frame.

6. The pavement cutting equipment according to claim 5, wherein:

the cutter assemblies successively increase the depth of the cut being made by the cutter assemblies.

7. The pavement cutting equipment according to claim 5, wherein:

the cutting depth of each of the cutter assemblies is adjustable independently of the other of the cutter assemblies.

8. The pavement cutting equipment according to claim 1, wherein:

the pavement cutting equipment comprises a towing vehicle for towing the pavement cutting apparatus; and the first cutter-mounting frame of the pavement cutting apparatus is coupled by the coupling to the towing vehicle.

9. The pavement cutting equipment according to claim 8, wherein:

the first cutter-mounting frame of the pavement cutting apparatus is an integral part of the towing vehicle.

10. The pavement cutting equipment according to claim 8, including:

a second pavement cutting apparatus; the second pavement cutting apparatus comprising;

a second cutter-mounting frame having one or more cutter assemblies mounted thereon for making a cut in a pavement; the second cutter-mounting frame, relative to a cutting direction of travel for the second pavement cutting apparatus when the second pavement cutting apparatus is cutting a pavement, having a leading end and a trailing end;

a second coupling for pivotally connecting the leading end of the second cutter-mounting frame to a towing vehicle for towing the first and second pavement cutting apparatus so that the second cutter-mounting frame pivots about a vertical or substantially vertical axis passing through the second coupling; and each of the one or more cutter assemblies on the second cutter-mounting frame having a driven rotary saw blade; the rotary saw blade of each of the one or more cutter assemblies mounted on the second cutter-mounting frame being a disc with peripheral cutting teeth; and the disc of the rotary saw blade of each of the one or more cutter assemblies mounted on the second cutter-mounting frame being located in a common vertical or substantially vertical plane that contains the vertical or substantially vertical pivot-axis of the second coupling whereby when the second pavement cutting apparatus is being towed in the cutting direction of travel for the second pavement cutting apparatus to form a generally vertically extending cut in a pavement, the rotary saw blade of each of the one or more cutter assemblies mounted on the second cutter-mounting frame follows the vertical or substantially vertical pivot-axis of the second coupling, the rotary saw blade of each of the one or more cutter assemblies mounted on the second cutter-mounting frame is aligned with and contained in a common plane with the vertical or substantially vertical pivot-axis of the second coupling, and, where there are a plurality of the cutter assemblies mounted on the second cutter-mounting frame, the rotary saw blade of each of the cutter assemblies mounted on the second cutter-mounting frame is aligned with and in the same plane as the rotary saw blade of each of the one or more other cutter assemblies mounted on the second cutter-mounting frame; and the second pavement cutting apparatus is coupled by the second coupling to the towing vehicle at a location spaced from a location where the first pavement cutting apparatus is coupled to the towing vehicle whereby, in use, the cutter assemblies mounted on the first and second cutter-mounting frames of the first and second pavement cutting apparatuses form parallel spaced apart cuts when the first and second pavement cutting apparatuses are being towed in the cutting direction of travel for the pavement cutting apparatuses.

11. The pavement cutting equipment according to claim 10, wherein:

the first and second cutter-mounting frames of the pavement cutting apparatus are each an integral part of the towing vehicle.

12. The pavement cutting equipment according to claim 8, wherein:

there are a plurality of the cutter assemblies mounted on the first cutter-mounting frame.

13. The pavement cutting equipment according to claim 12, wherein:

the cutter assemblies successively increase the depth of the cut being made by the cutter assemblies.

14. The pavement cutting equipment according to claim 12, wherein:

the cutting depth of each of the cutter assemblies is adjustable independently of the other of the cutter assemblies.

15. The pavement cutting equipment according to claim 8, wherein:

there are a series of at least three of the cutter assemblies mounted on the first cutter-mounting frame.

16. The pavement cutting equipment according to claim 15, wherein:

the cutter assemblies successively increase the depth of the cut being made by the cutter assemblies.

17. The pavement cutting equipment according to claim 15, wherein:

the cutting depth of each of the cutter assemblies is adjustable independently of the other of the cutter assemblies.

18. A method for cutting a concrete or asphalt pavement, comprising:

providing pavement cutting equipment comprising a first pavement cutting apparatus and a pavement cutting apparatus towing vehicle; the first pavement cutting apparatus comprising: a first cutter-mounting frame having one or more cutter assemblies mounted thereon for making a cut in a pavement; the first cutter-mounting frame, relative to a cutting direction of travel for the first pavement cutting apparatus when the first pavement cutting apparatus is cutting a pavement, having a leading end and a trailing end; a first coupling pivotally connecting the leading end of the first cutter-mounting frame to the towing vehicle so that the first cutter-mounting frame pivots about a vertical or substantially vertical pivot-axis passing through the first coupling; each of the one or more cutter assemblies mounted on the first cutter-mounting frame having a driven rotary saw blade; the rotary saw blade of each of the one or more cutter assemblies being a disc with peripheral cutting teeth; and the disc of the rotary saw blade of each of the one or more cutter assemblies being located in a common vertical or substantially vertical plane that also contains the vertical or substantially vertical pivot-axis of the first coupling whereby when the first pavement cutting apparatus is being towed in the cutting direction of travel for the first pavement cutting apparatus to form a generally vertically extending cut in a pavement, the rotary saw blade of each of the one or more cutter assemblies follows the vertical or substantially vertical pivot-axis of the first coupling, the rotary saw blade of each of the one or more cutter assemblies is aligned with and contained in a common plane with the vertical or substantially vertical pivot-axis of the first coupling, and, where there are a plurality of the cutter assemblies mounted on the first cutter-mounting frame, the rotary saw blade of each of the cutter assemblies is aligned with and in the same plane as the rotary saw blade of each of the one or more other cutter assemblies; and forming a cut in a concrete or asphalt pavement with the one or more cutter assemblies by towing the first pavement cutting apparatus in the cutting direction of travel for the first pavement cutting apparatus with the towing vehicle.

19. The method of cutting a joint in a concrete or asphalt pavement according to claim 18, wherein:

there are a plurality of the cutter assemblies mounted on the first cutter-mounting frame.

20. The method of cutting a joint in a concrete or asphalt pavement according to claim 19, wherein:

the cutter assemblies successively increase the depth of the cut being made by the cutter assemblies.

21. The method of cutting a joint in a concrete or asphalt pavement according to claim 19, wherein:

the cutting depth of each of the cutter assemblies is adjustable independently of the other of the cutter assemblies.

22. The method of cutting a joint in a concrete or asphalt pavement according to claim 18, wherein:

there are a series of at least three of the cutter assemblies mounted on the cutter-mounting frame.

23. The method of cutting a joint in a concrete or asphalt pavement according to claim 18, wherein:

the pavement cutting equipment includes a second pavement cutting apparatus; the second pavement cutting apparatus comprising: a second cutter-mounting frame having one or more cutter assemblies mounted thereon for making a cut in a pavement; the second cutter-mounting frame, relative to a cutting direction of travel for the second pavement cutting apparatus when the second pavement cutting apparatus is cutting a pavement, having a leading end and a trailing end; a second coupling pivotally connecting the leading end of the second cutter-mounting frame to the towing vehicle so that the second cutter-mounting frame pivots about a vertical or substantially vertical axis passing through the second coupling; each of the one or more cutter assemblies mounted on the second cutter-mounting frame having a driven rotary saw blade; the rotary saw blade of each of the one or more cutter assemblies on the second cutter-mounting frame being a disc with peripheral cutting teeth; and the disc of the rotary saw blade of each of the one or more cutter assemblies on the second cutter-mounting frame being located in a common vertical or substantially vertical plane that also contains the vertical or substantially vertical axis of the second coupling whereby when the second pavement cutting apparatus is being towed in the cutting direction of travel for the second pavement cutting apparatus to form a generally vertically extending cut in a pavement, the rotary saw blade of each of the one or more cutter assemblies mounted on the second cutter-mounting frame follows the vertical or substantially vertical pivot-axis of the second coupling, the rotary saw blade of each of the one or more cutter assemblies mounted on the second cutter-mounting frame is aligned with and contained in a common plane with the vertical or substantially vertical pivot-axis of the second coupling, and, where there are a plurality of the cutter assemblies mounted on the second cutter-mounting frame, the rotary saw blade of each of the cutter assemblies mounted on the second cutter-mounting frame is aligned with and in the same plane as the rotary saw blade of each of the one or more other cutter assemblies mounted on the second cutter-mounting frame; and forming a cut in a concrete or asphalt pavement with the one or more cutter assemblies mounted on the second cutter-mounting frame that extends parallel to and is spaced from the cut made with the one or more cutter assemblies mounted on the first cutter-mounting frame by towing the first and second pavement cutting apparatuses in the cutting direction of travel for the first and second pavement cutting apparatuses with the towing vehicle.

* * * * *